US005798609A

United States Patent [19]

Sol

[11] Patent Number: 5,798,609

[45] Date of Patent: Aug. 25, 1998

[54] FLAT DISPLAY SCREEN WITH A WIDE INTER-ELECTRODE SPACING

[75] Inventor: Jean-Marc Sol, Montpellier, France

[73] Assignee: Pixtech S.A., Rousset, France

[21] Appl. No.: 614,398

[22] Filed: Mar. 12, 1996

[30] Foreign Application Priority Data

Mar. 17, 1995 [FR] France ..... 95 03376

[51] Int. Cl.[6] ..... H01J 1/66; H01J 1/70

[52] U.S. Cl. ..... 313/495; 313/238; 313/283

[58] Field of Search ..... 313/238, 283, 313/422, 495

[56] References Cited

U.S. PATENT DOCUMENTS

| | | | |
|---|---|---|---|
| 3,935,500 | 1/1976 | Oess et al. . | |
| 4,857,799 | 8/1989 | Spindt et al. | 313/422 X |
| 4,940,916 | 7/1990 | Borel et al. | 313/306 |
| 5,015,912 | 5/1991 | Spindt et al. | 313/422 X |
| 5,223,766 | 6/1993 | Nakayama et al. | 313/495 |
| 5,442,255 | 8/1995 | Ise et al. | 313/495 |
| 5,453,659 | 9/1995 | Wallace et al. | 313/495 |
| 5,491,376 | 2/1996 | Levine et al. | 313/495 |

FOREIGN PATENT DOCUMENTS

| | | |
|---|---|---|
| 0476975 | 3/1992 | European Pat. Off. . |
| 0585081 | 3/1994 | European Pat. Off. . |
| 8801098 | 2/1988 | WIPO . |

*Primary Examiner*—Hezron E. Williams
*Assistant Examiner*—Daniel S. Larkin
*Attorney, Agent, or Firm*—Plevy & Associates

[57] ABSTRACT

A flat display screen includes two electrodes separated by an inner space. At least one first electrode is supported by a thin substrate and by a thick rigidifying plate, the inner space being defined by a peripheral frame placed between the electrodes, outside their useful surface.

10 Claims, 2 Drawing Sheets

FLAT DISPLAY SCREEN WITH A WIDE INTER-ELECTRODE SPACING

BACKGROUND OF THE INVENTION

1. Field of the Invention

The present invention relates to the fabrication of a flat display screen with a wide inter-electrode spacing, such as a flat display screen in which an electron emission is obtained by extraction of electrons from microtips or from a thin film, for example a carbon-diamond film.

The invention more particularly relates to a flat display screen comprising a cathode including microtips for electronically bombarding an anode including phosphor elements. This type of screen is conventionally referred to as a microtip fluorescent screen.

2. Discussion of the Related Art

FIG. 1 represents the structure of a flat microtip screen.

Such a microtip screen is mainly constituted by a cathode 1 including microtips 2 and by a gate 3 that is provided with holes 4 facing the microtips 2. The cathode 1 faces a cathodoluminescent anode 5 having a glass substrate 6 that constitutes the screen surface.

The operation and the detailed structure of such a microtip display are described in U.S. Pat. No. 4,940,916 assigned to Commissariat à l'Energie Atomique.

The cathode 1 is divided into columns and is constituted, on a glass substrate 10, by cathode conductors organized in meshes from a conductive layer. The microtips 2 are realized on a resistive layer 11 that is deposited on the cathode conductors and are disposed inside meshes defined by the cathode conductors. FIG. 1 partially represents the interior of a mesh, the cathode conductors are not shown in this figure. The cathode 1 is associated with gate 3 which is arranged in rows, an insulating layer (not shown) being interposed between the cathode conductors and gate 3. The intersection of a row of gate 3 and a column of cathode 1 defines a pixel.

The device uses the electric field generated between cathode 1 and gate 3 for extracting electrons from microtips 2 towards phosphor elements 7 of anode 5. In the case of a color display screen, anode 5 is provided with alternating strips of phosphor elements 7, each strip corresponding to a color (red, green, blue). The strips are separated one from the other by an insulator 8. The phosphor elements 7 are deposited onto electrodes 9, that are constituted by corresponding strips of a transparent conductive layer, such as indium-tin oxide (ITO). The groups of red, green, blue strips are selectively polarized with respect to cathode 1, so that the electrons extracted from the microtips 2 of one pixel of the cathode/gate are selectively directed toward the phosphor elements 7 facing each of the colors.

The assembly of the two substrates 6 and 10, supporting anode 5 and cathode 1, respectively, provides an internal space 12 where the electrons emitted by cathode 1 flow.

The problem encountered lies in the formation of the space 12, because the distance between cathode 1 and anode 5 must be constant so that the brightness of the screen is regular over its whole surface.

FIG. 2 is a cross-sectional view of an assembled screen illustrating exemplary means for defining the space 12 between the electrodes.

The details of the structure of cathode 1, gate 3 and anode 5 are not represented in FIG. 2 for the sake of clarity.

The space 12 between the electrodes is conventionally defined by spacers regularly distributed over the whole screen surface between gate 3 and anode 5. These spacers are, for example, formed by glass beads 13. The substrates 6 and 10 respectively supporting anode 5 and the cathode/gate are assembled together with a peripheral sealing, for example, with a seam 14 of molten glass. The use of spacers is necessary because of the pressure difference between the inside and the outside of the screen which tends to deform substrates 6 and 10 due to their small thickness (approximately 1 mm) with respect to the screen's surface (several hundred square cm).

A drawback of using spacers 13 distributed over the whole useful surface of the screen is that they constitute obstacles to the path of the electrons emitted by microtips 2. These obstacles cause shadow areas on the screen because the phosphor elements 7 facing them cannot receive electrons. Even though the spherical shape limits this effect by decreasing the contact surface between a bead 13 and a phosphor element 7, this is only true for small-diameter beads.

Indeed, the larger the diameter of beads 13, the more visible these beads are on the screen surface by generating shadow areas. This requires the use of small-diameter beads, which limits the thickness of the vacuum space 12 and therefore the space between anode 5 and cathode 1. The smaller the space between anode 5 and cathode 1, the lower the anode-cathode voltage must be to prevent the formation of electric arcs which would destroy the screen. However, the anode-cathode voltage is directly related to the screen's brightness. Thus, the more the shadow areas due to the spacers are decreased by decreasing the diameter of the spacers, the more the anode-cathode voltage must be reduced, and the more the screen's brightness is decreased.

The diameter of the beads is conventionally limited to approximately 200 μm to avoid generation of shadow areas. The anode-cathode voltage is then limited to approximately 500 to 1000 volts.

A further drawback is that these spacers 13 can only be fixed on one of the substrates, generally the cathode substrate, by gluing, soldering or similar means. Such techniques pollute the cathode's surface and require vacuum thermal processes for degassing the glue or soldering residues. Degassing is achieved through a pumping tube 15 enabling communication of the internal space 12 with pumping means (not shown) through a hole 16 formed in one of the substrates (for example, substrate 10). Tube 15, generally of glass, is mounted to substrate 10, for example, by resting on the external surface of substrate 10 with a shoulder 17 which is bonded by molten glass (not shown). This tube 15 is sealed, after degassing, when the inner space 12 has been emptied or filled with a low pressure gas.

A further drawback of conventional screens is that the pumping tube 15, when sealed, protrudes perpendicularly to the screen plane and constitutes a fragile area.

SUMMARY OF THE INVENTION

An object of the present invention is to avoid these drawbacks by providing a flat display screen with a wide spacing between the electrodes enabling operation of the screen at a high anode-cathode voltage, without having shadow areas and in which the definition of the space between the electrodes does not cause pollution of the inner surface of the substrates.

A further object of the present invention is to provide a flat display screen in which the pumping tube is not a fragile area.

To achieve these objects, the present invention provides a flat display screen including two electrodes separated by an inner space, at least one first electrode is supported by a thin substrate and by a thick rigidifying plate, the inner space being defined by a peripheral frame placed between the electrodes, outside their useful surface.

According to an embodiment of the invention, a second electrode is supported by a thick rigidifying plate which constitutes a thick substrate on the inner surface of which the second electrode is formed.

According to an embodiment of the present invention, the second electrode is supported by a thin substrate and by a thick rigidifying plate.

According to an embodiment of the present invention, the plate associated with the first electrode forms the bottom of the screen and has a hole for the passage of a pumping tube which is associated with the substrate supporting the first electrode and designed to allow vacuum generation in the inner space.

According to an embodiment of the present invention, the assembly of a plate with the substrate associated thereto is achieved by bonding this plate to an external surface of this substrate, once all the elements constituting the electrode supported by this substrate on an inner surface are formed.

According to an embodiment of the present invention, the first electrode is constituted by a microtip cathode for electron bombarding of an anode provided with phosphor elements.

According to an embodiment of the present invention, a rigidifying plate which forms the screen surface is transparent and grooved, at its inner surface, according to a pattern of meshes corresponding to the distribution of the pixels of the screen, these grooves being filled with an opaque material.

According to an embodiment of the present invention, a metallic layer is deposited over the external surface of the substrate which is associated with a rigidifying plate forming the screen surface, and defines a pattern of meshes corresponding to the distribution of the pixels of the screen.

According to an embodiment of the present invention, a rigidifying plate which forms the screen surface is assembled with the substrate associated thereto by electrostatic bonding of a metallic grid having a meshing corresponding to the distribution of the pixels of the screen and is placed between this plate and the substrate associated thereto.

According to an embodiment of the present invention, the thickness of the rigidifying plate ranges from 4 mm to 5 cm and the thickness of the frame ranges from 0.5 mm to 5 mm.

The foregoing and other objects, features, aspects and advantages of the invention will become apparent from the following detailed description of the present invention when taken in conjunction with the accompanying drawings.

BRIEF DESCRIPTION OF THE DRAWINGS

For the sake of clarity, the figures are not drawn to scale and the same elements are referenced with the same reference characters in the figures.

DETAILED DESCRIPTION

Figure 3:
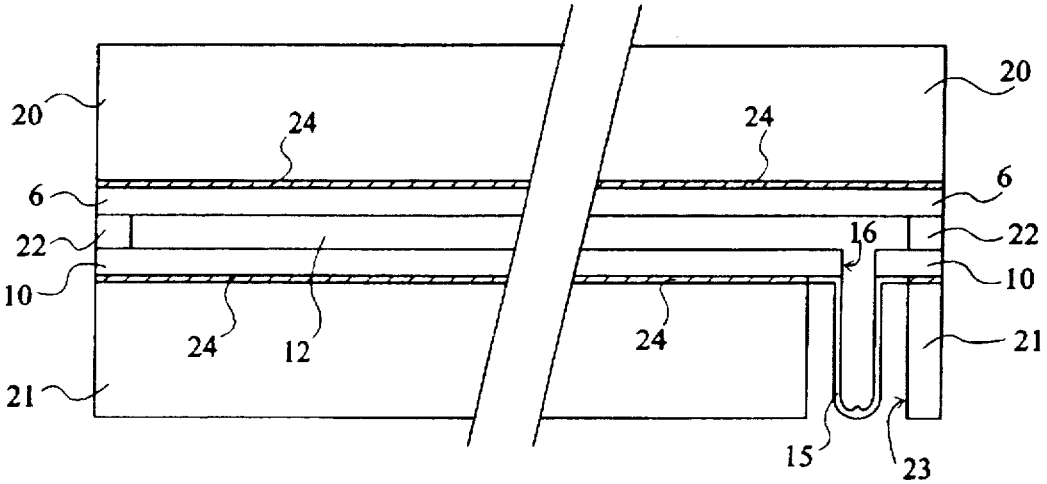
FIG. 3 is a schematic cross-sectional view of an embodiment of a flat display screen according to the present invention.

As shown in FIG. 3, the present invention uses thick and rigid plates 20 and 21, respectively, fixed to the external surfaces of the screen to rigidify the structure. Thus, the space 12 between the electrodes can be defined by a simple peripheral rigid frame 22 without it being necessary to provide internal spacers to avoid deformation of substrates 6 and 10 supporting the anode and gate/cathode, respectively.

According to the invention, a rigid peripheral frame 22 having a thickness corresponding to the desired thickness of the inner or inter-electrode spacing 12 is preferably used.

Indeed, since spacers are no longer distributed over the whole surface of the screen, the distance between the electrodes 12 is difficult to predetermine when using a simple seam of molten glass because of its flattening during the melting. Thus, according to the invention, the assembly of substrates 6 and 10 is, for example, achieved with two molten glass seams (not shown) that are interposed between each surface of the frame 22 and the substrate 6 or 10 with which this surface is associated.

Thus, according to the invention, it is possible to increase the space 12 between the electrodes of the screen by increasing the thickness of frame 22 and to size the plates 20 and 21 so that they provide the screen with a sufficient rigidity, avoiding deformation due to the pressure difference between the outside and the inside of the screen. Therefore, it is no longer necessary to use spacers in the space between the electrodes which is thus free of the shadow effects caused by the spacers. In addition, the omission of spacers avoids pollution of the inner surface of the substrates due to gluing, soldering, or other means, of the spacers.

The thickness of plates 20 and 21 depends upon the screen surface. The thickness of plates 20 and 21, for example, ranges from 4 mm to 5 cm and the thickness of the rigid frame 22, for example, ranges from 0.5 mm to 5 mm.

The use of the additional rigidifying plates 20 and 21 avoids impairing of the formation of the cathode/gate and anode over the substrates, 6 and 10 respectively.

Figure 1:
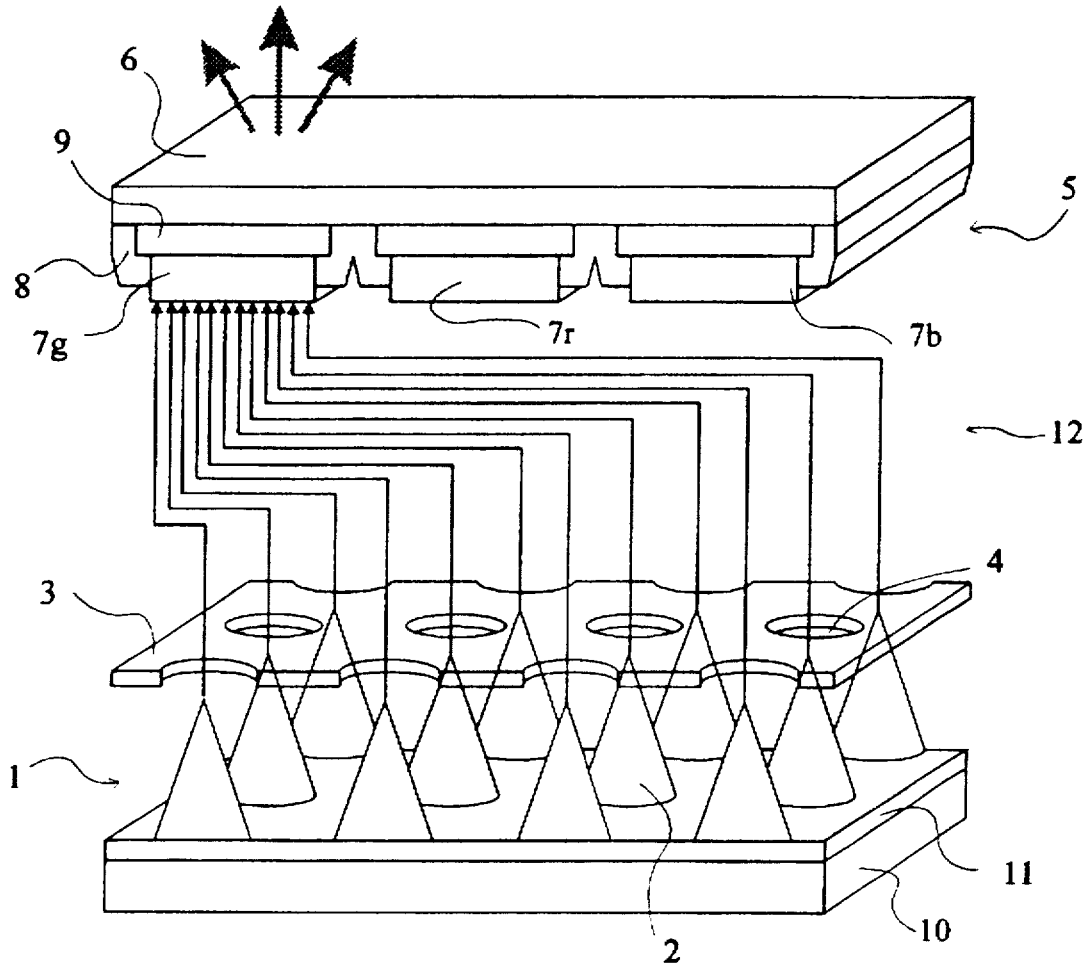
Fig 1 (PRIOR ART)
FIGS. 1 and 2, above described, are intended to illustrate the state of the art and the related problem.
Figure 2:
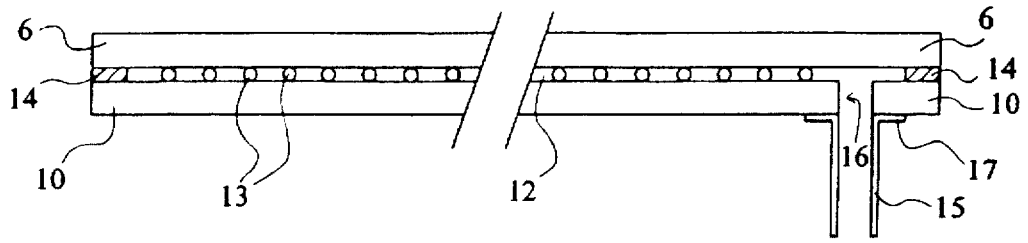
Fig 2 (PRIOR ART)

Indeed, as indicated with relation with FIG. 1, this formation uses thin layer deposition techniques which generally require the use of thin substrates, especially because of the thermal inertia of glass which generally constitutes them. Using a thick substrate decreases the temperature rising and decreasing speeds which are already very slow, for example, for the chemical vapor deposition (CVD) of the resistive layer 11 generally of silicon.

In addition, using thick substrates causes deformation risks during the various thermal processes (for example, degassing or deposition) to which these substrates are subjected.

Furthermore, the execution of some steps of the fabrication method of the electrodes, in particular of the cathode, requires the use of thin substrates, especially because of the rotation of these substrates (spin deposition).

The invention enables the use of a substrate having a conventional thickness ranging, for example, from 0.5 mm to 1.5 mm.

The thickness requirements for the substrates are particularly critical for the formation of the cathode/gate. Indeed, substrate 10 supporting the cathode receives a large number of layers, the formation of which requires high temperatures. Thus, the thermal inertia of a thick substrate would lead to an excessively long fabrication time because of the plurality of temperature rising and decreasing steps.

Conversely, the formation of anode 5 on a substrate 6 requires a smaller number of deposition steps. In addition, the patterns (the conductor strips) can be serigraphically etched. Thus, according to an alternative of the invention, the substrate 6 may directly have the final thickness necessary for the desired rigidity of the screen, plate 20 being then integral with substrate 6.

In the case where one of the substrates (generally, substrate 10 supporting cathode 1) is provided with a pumping tube 15, plate 21 associated with substrate 10 includes a hole 23 for the passage of tube 15.

This provides a further advantage to the present invention. This advantage lies in that tube 15 no longer protrudes perpendicularly to the screen, once the screen is assembled. The protrusion of tube 15 which generally has a length of 6 mm when closed is, as shown in FIG. 3, accommodated in the thickness of plate 21. Thus, this protrusion is within the global bulk of the finished screen and is no longer a fragile area.

The choice of the material constituting plates 20 and 21 more particularly depends on the desired bulk and weight of the screen and on the assembly requirements for each plate 20 and 21 with substrate 6 or 10 with which they are associated.

The plate constituting the screen surface (generally, plate 20 associated with substrate 6 supporting anode 5) is inevitably transparent to enable display. In contrast, the plate (for example 21) constituting the bottom of the screen can be opaque.

By way of a specific example, with a space between the electrodes of approximately 1 mm, the thickness of glass plates 20 and 21 is approximately 4 mm for a rectangular screen having a 10-cm diagonal and is approximately 2 cm for a screen having a 30-cm diagonal.

Thus, a transparent plate, for example of glass, has the same thermal expansion coefficient as the glass substrate with which it is associated.

A transparent plate can also be made of a transparent organic material, for example polycarbonate or plexiglass. An organic material is advantageous in that it is lighter than glass.

A transparent plate can also be achieved with transparent laminated glass. It can be, for example, a sheet of polyvinylbutyral, polyurethane, or silicon sandwiched between two glass sheets. The use of laminated glass is advantageous in that it is lighter and has an increased resistance to shocks as compared to glass.

An opaque plate associated with the screen bottom can, for example, be made of ceramics, metal or any opaque plastics. An opaque plate can also be provided with a honeycomb or mesh structure to reduce its weight without reducing resistance. The substrate, at the bottom of the screen (for example, substrate 10 supporting the cathode), can also be opaque and, for example, made of ceramics.

However, during assembly, care should be taken to ensure that the surface of the plates to assemble with a substrate are in a material compatible with the material constituting the substrate. More particularly, the assembly of plates 20 and 21 with substrates 6 and 10, respectively, must be compatible with the temperature for assembling the substrates together. In other words, the assembly of the plates with the substrates must not impair the assembly of the substrates together, for example, by means of peripheral molten glass seams, and inversely.

In an exemplary embodiment, plates 20 and 21 are assembled with their respective substrate 6 or 10 with a molten glass layer 24 therebetween (which is transparent). The melting temperature of the glass layer 24 is selected slightly higher than the melting temperature of the glass seams (not shown) used subsequently to assemble substrates 6 and 10 with frame 22 therebetween.

According to an alternative embodiment, substrates 6 and 10 are assembled together in a controlled atmosphere, for example nitrogen, and are sealed at high temperature. Then, plates 20 and 21 are fastened and bonded at low temperature to substrates 6 and 10. The inner space 12 is then pumped empty through the pumping tube 15 which is then sealed at its free end.

Thus, the invention provides a screen devoid of shadow areas. In addition, the invention increases the anode-cathode voltage and thus the brightness of the screen.

Another advantage of the present invention is that the plate 20 which constitutes the surface of the screen can be quenched to increase its resistance and/or be tinted. This is not possible for conventional screens because glass quenching processes require glass at least 3 mm thick.

If necessary, plate 20 can be used to constitute or to support a tactile screen device.

A further advantage of the present invention is that it allows achieving, on the side of the plate constituting the screen surface (for example plate 20 associated with the anode), a transparent matrix separated by an opaque meshing which corresponds to the distribution of the pixels. An advantage of such a matrix is that it forms the pixels of the screen, on the side of its surface. This improves the quality of the display and, particularly, the outlines of the various subjects of an image while avoiding perception of fade-out between two adjacent pixels. In addition, the opaque meshing reduces the spurious reflections of the incident light on the screen, thus improving the image contrast.

Figure 4:
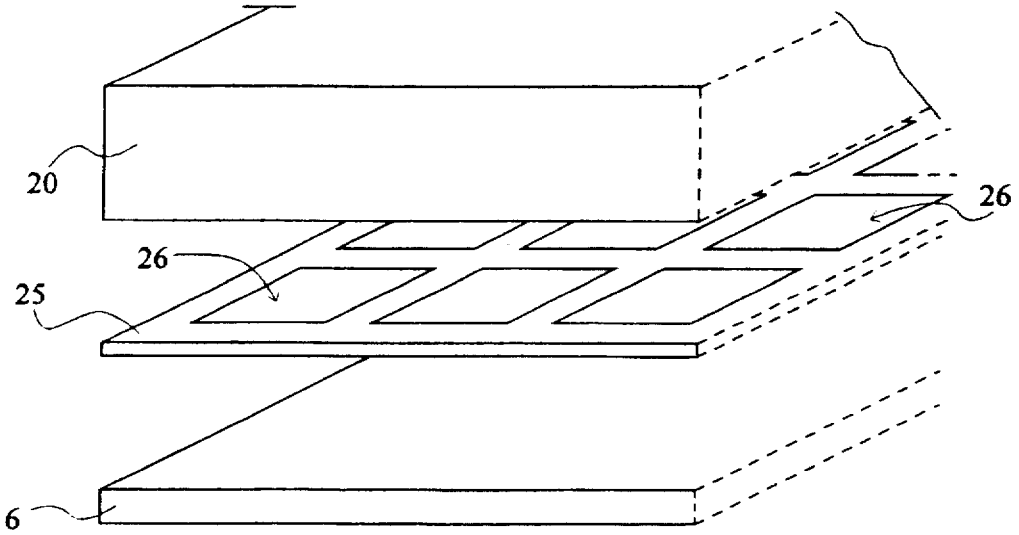
FIG. 4 is a schematic exploded partial perspective view of a second embodiment of a flat display screen according to the present invention.

FIG. 4 is a perspective exploded view illustrating a second alternative embodiment of the present invention in which the plate (for example 20) cooperates to form such a matrix.

According to this embodiment, plate 20 is assembled to substrate 6 through an opaque metallic grid 25 having a meshing 26 that corresponds to the distribution of the pixels on the screen. For this purpose, the metallic grid 25 is placed between substrate 6 and plate 20. Then, the grid 25 is biased, for example, at 500 volts, and the whole assembly is heated at a high temperature, for example 450° C., for approximately 10 minutes so as to cause electrostatic bonding.

The metallic grid 25 can also be replaced with an opaque adhesive layer deposited according to the desired pattern of meshes 26.

According to an alternative (not shown), the grid is formed by metal deposition on the external surface of substrate 6 which is then bonded to plate 20, as shown with relation to the first embodiment.

The metallic grid 25 can be connected to ground to take advantage of the electrostatic shielding effect.

According to another alternative (not shown), the matrix is formed inside plate 20. For this purpose, plate 20 is grooved, preferably at its inner surface, according to the desired opaque mesh pattern. The grooves are then filled with an opaque material, for example, epoxy resin. Finally, plate 20 is assembled with substrate 6, as indicated with relation to the first embodiment, to obtain the desired matrix.

As is apparent to those skilled in the art, various modifications can be made to the present invention. In particular, each of the described elements of a layer can be replaced with one or more elements having the same function. In addition, the sizes given by way of example can be modified as a function of the intrinsic rigidity of the plates that are used.

In addition, although rectangular screens have been cited by way of example, the invention applies to screens of any shape, either square, circular, polygonal or other.

Furthermore, although microtips screens have been referred to in the above description, the present invention also applies to fluorescent screens of the type including an electronic emission film, for example of carbon-diamond.

Having thus described at least one illustrative embodiment of the invention, various alterations, modifications and improvements will readily occur to those skilled in the art. Such alterations, modifications, and improvements are intended to be within the spirit and scope of the invention. Accordingly, the foregoing description is by way of example only and is not intended to be limiting. The invention is limited only as defined in the following claims and the equivalents thereto.

What is claimed:

1. A flat display screen including a first electrode (1) and a second electrode (5), said first and second electrodes separated by an inner space (12), wherein at least one of said first and second electrodes (1, 5) is supported by a thin substrate plate (10) and by a thick rigidifying plate (21) flush-mounted to said thin substrate plate, said inner space (12) being defined by a peripheral frame (22) placed between said first and second electrodes (1, 5), outside their useful surface.

2. The flat display screen of claim 1, wherein said second electrode (5) is supported by a thick rigidifying plate (20) constituting a thick substrate on the inner surface of which the second electrode (5) is formed.

3. The flat display screen of claim 1, wherein said second electrode (5) is supported by a thin substrate plate (6) and by a thick rigidifying plate (20) flush-mounted to said thin substrate plate (6).

4. The flat display screen of claim 1, wherein said thick rigidifying plate (21) associated with the first electrode (1) forms the bottom of the screen and has a hole (23) for the passage of a pumping tube (15) which is associated with said thin substrate plate (10) supporting the first electrode (1) and designed to allow vacuum generation in the inner space (12).

5. The flat display screen of, claim 3 wherein the assembly of each said thick rigidifying plate (20, 21) with each said thin substrate plate (6, 10) associated thereto is achieved by bonding each said thick rigidifying plate (20, 21) to an external surface of each said thin substrate plate (6, 10), once all the elements constituting each said electrode (5, 1) supported by each said thin substrate plate (6, 10) on an inner surface are formed.

6. The flat display screen of claim 1, wherein said first electrode comprises a cathode (1), said cathode including microtips (2) for electron bombarding of an anode (5) provided with phosphor elements (7).

7. The flat display screen of claim 3, wherein said thick rigidifying plate (20) which forms the screen surface is transparent and grooved, at its inner surface, according to a pattern of meshes (26) corresponding to the distribution of the pixels of the screen, said grooves being filled with an opaque material.

8. The flat display screen of claim 3, wherein a metallic layer is deposited over the external surface of the thin substrate pate (6) associated with said rigidifying plate (20) forming the screen surface to form a metal grid having a meshing (26) corresponding to the distribution of the pixels of the screen.

9. The flat display screen of claim 3, wherein said thick rigidifying plate (20) which forms the screen surface is assembled with the thin substrate plate (6) associated thereto by electrostatic bonding of a metallic grid (25) having a meshing (26) corresponding to the distribution of the pixels of the screen, said metallic grid disposed between said thick rigidifying plate (20) and the thin substrate plate (6) associated thereto.

10. The flat display screen of claim 1, wherein the thickness of each said thick rigidifying plate (20, 21) ranges from 4 mm to 5 cm and the thickness of said frame (22) ranges from 0.5 mm to 5 mm.

* * * * *